US005823148A

United States Patent [19]

Housand, Sr.

[11] Patent Number: 5,823,148

[45] Date of Patent: Oct. 20, 1998

[54] APPARATUS FOR INTRODUCING COMBUSTION SUPPORTING PARTICLES TO AN INTERNAL COMBUSTION ENGINE

[76] Inventor: Raymond W. Housand, Sr., 22875 22 Mile Rd., Paris, Mich. 49338

[21] Appl. No.: 654,524

[22] Filed: May 29, 1996

[51] Int. Cl.[6] ..... F02B 75/12

[52] U.S. Cl. ..... 123/1 A

[58] Field of Search ..... 123/1 A

[56] References Cited

U.S. PATENT DOCUMENTS

| | | | |
|---|---|---|---|
| 4,440,115 | 4/1984 | Allen | 123/1 A |
| 4,858,582 | 8/1989 | Brown | 123/1 A |
| 5,002,033 | 3/1991 | Housand, Sr. | 123/1 A |
| 5,113,804 | 5/1992 | Kraus et al. | 123/1 A |
| 5,154,142 | 10/1992 | Kamo | 123/1 A |
| 5,331,924 | 7/1994 | Kraus | 123/1 A |
| 5,386,804 | 2/1995 | Guttmann et al. | 123/1 A |

*Primary Examiner*—Erick R. Solis
*Attorney, Agent, or Firm*—Price,Heneveld,Cooper, DeWitt & Litton

[57] ABSTRACT

A simple, inexpensive apparatus for introducing a mixture of vaporized fuel, air and combustion supporting particles to an internal combustion engine to improve combustion efficiency and to reduce emissions of incompletely combusted hydrocarbon fuels is provided. The apparatus includes a single chamber for containing a volume of liquid fuel and a volume of vaporized fuel, a supply of combustion supporting particles disposed within the chamber, a conduit for supplying liquid fuel to the chamber, a conduit for supplying air to the chamber, a liquid level controller for maintaining the volume of liquid fuel in the chamber within predetermined limits, and an outlet from the chamber for conveying a mixture of vaporized fuel, air and combustion supporting particles to a vacuum inlet of an internal combustion engine. The disclosed apparatus is utilized in a combination including an internal combustion engine and a fuel system therefor, to improve the fuel economy of motor driven vehicles.

7 Claims, 1 Drawing Sheet

APPARATUS FOR INTRODUCING COMBUSTION SUPPORTING PARTICLES TO AN INTERNAL COMBUSTION ENGINE

FIELD OF THE INVENTION

This invention relates to an apparatus for entraining combustion supporting particles in a mixture of vaporized fuel and air, and introducing the resulting mixture of vaporized fuel, air and entrained combustion supporting particles into a combustion chamber of an internal combustion engine.

BACKGROUND OF THE INVENTION

It is well known that internal combustion engines do not combust all of the fuel which is introduced to the combustion chambers thereof. Although pollution problems associated with the incomplete combustion of fuel in internal combustion engines has been successfully overcome by introducing the exhaust gases from the combustion chamber or chambers of the internal combustion engine to a catalytic convertor, there has only been relatively modest improvements in the combustion efficiency and hence fuel economy of internal combustion engines. Prior attempts to improve the combustion efficiency of internal combustion engines have generally either involved extensive modifications which were impractical because of the increased complexity and expense of manufacturing and maintaining the engine, or they have involved the use of simpler devices which have only provided a relatively modest improvement in fuel efficiency.

In U.S. Pat. No. 5,002,033, issued on Mar. 26, 1991, I disclosed a relatively simple apparatus for improving combustion efficiency, reducing hydrocarbon emissions, and providing improved fuel economy. The apparatus is used for preparing and supplying a mixture of fuel, air and combustion supporting particles to an internal combustion engine, whereby fuel is more efficiently combusted. The apparatus includes a first chamber for preparing a mixture of vaporized fuel and air, and a second chamber for preparing a mixture of vaporized fuel, air and combustion supporting particles. The output from the two chambers are mixed and introduced to the combustion chamber or chambers of an internal combustion engine. The apparatus utilizes at least one ultrasonic transducer for applying energy to the fuel in the major chamber for causing a portion of the fuel to vaporize and mix with air in the major chamber. The use of ultrasonic transducers in the apparatus introduces a number of complications. For example, effective utilization of the ultrasonic transducers requires that the ultrasonic transducers be mounted in the bottom wall of the major chamber in immediate fluid contact with the fuel in the chamber, thus requiring the use of sealing materials to prevent gasoline from escaping from around the transducers. It has also been found that it is relatively difficult to provide an inexpensive chamber which is suitable for the environment in which the apparatus will be utilized, and which is capable of withstanding the vibrations of the ultrasonic transducer for a prolonged period of time. Further, the apparatus disclosed in U.S. Pat. No. 5,002,033 utilizes an auxiliary fuel pump for supplying fuel to the major chamber. Thus, while the disclosed apparatus achieves improved combustion efficiency, e.g. as much as 50% or more, it would be desirable to provide a simpler apparatus which achieves comparable results.

SUMMARY OF THE INVENTION

It is an object of this invention to provide a simple, inexpensive apparatus for introducing a mixture of vaporized fuel, air and combustion supporting particles to an internal combustion engine to improve combustion efficiency, reduce emissions of incompletely combusted hydrocarbon fuels, and thus provide improved fuel economy, while facilitating easy installation and maintenance of the apparatus. Specifically, it an object of this invention to provide a simplified apparatus which utilizes only a single chamber for volatilizing a liquid hydrocarbon fuel, mixing the volatilized hydrocarbon fuel with air, and entraining combustion supporting particles in the mixture of volatilized fuel and air. It is a further object of the invention to achieve the foregoing results without employing ultrasonic transducers or other electrically powered means for vaporizing the liquid hydrocarbon fuel, and to eliminate the need for an auxiliary fuel pump.

It has been found that the foregoing objects can be achieved by employing a simplified apparatus for introducing combustion supporting particles to an internal combustion engine, which comprises a single chamber for containing a volume of liquid fuel and a volume of vaporized fuel, a supply of combustion supporting particles disposed within the chamber, a conduit for supplying liquid fuel to the chamber, a conduit for supplying air to the chamber, a liquid level controller for maintaining the volume of liquid fuel in the chamber within predetermined limits, and an outlet from the chamber for conveying a mixture of vaporized fuel, air and combustion supporting particles to a vacuum inlet of an internal combustion engine.

DESCRIPTION OF THE PREFERRED EMBODIMENTS

Figure 1:
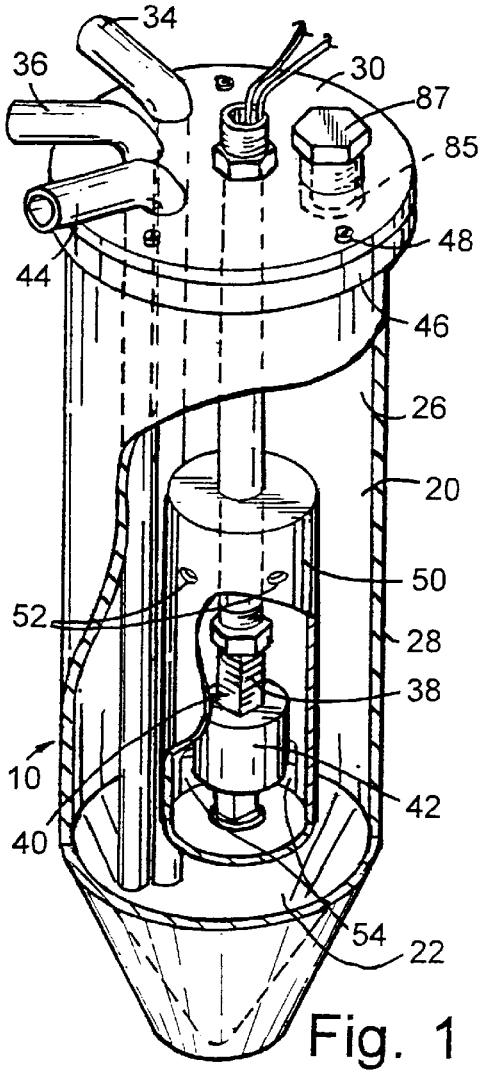
FIG. 1 is perspective view of an apparatus for introducing combustion supporting particles to an internal combustion engine, with portions broken away to show the internal components thereof.
Figure 2:
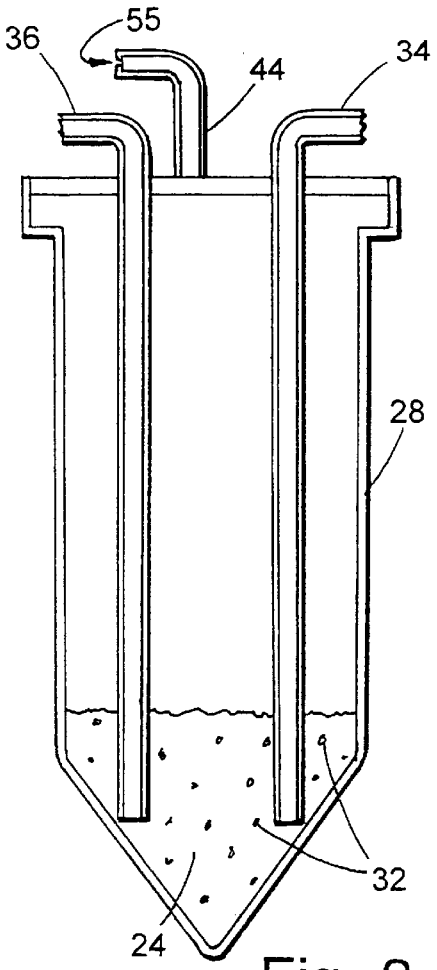
FIG. 2 is an elevational cross section of the apparatus.
Figure 3:
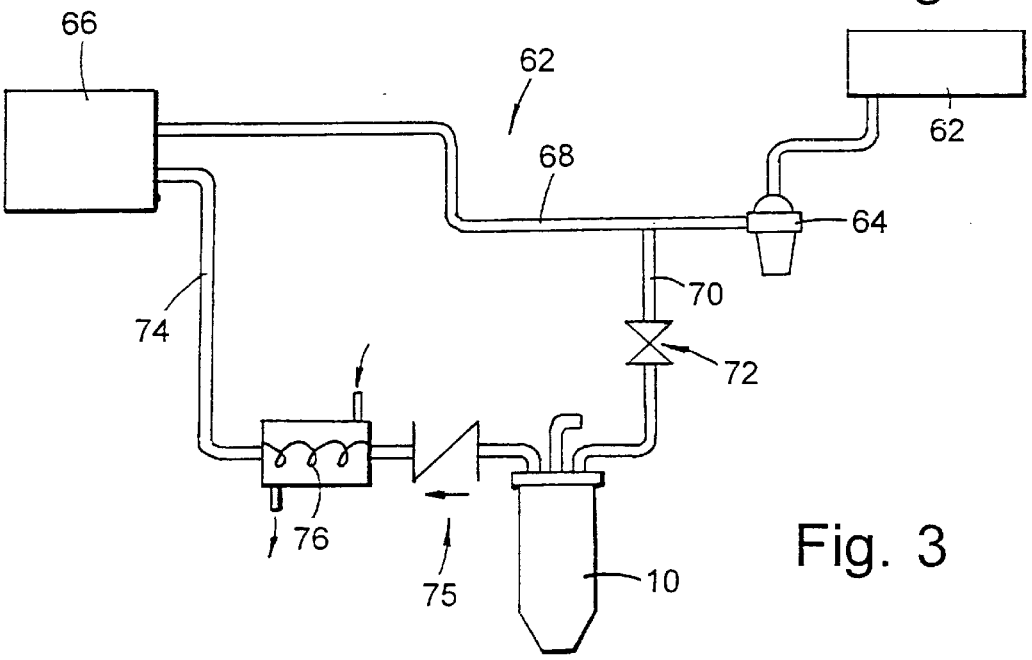
FIG. 3 is a schematic illustration of a fuel system utilizing the apparatus shown in FIG. 1.

Shown in FIGS. 1 and 2 is an improved apparatus 10 for introducing combustion supporting particles to an internal combustion engine. The apparatus includes a single chamber 20 having a lower portion 22 for containing a volume of liquid fuel 24 and an upper portion 26 for containing a volume of vaporized fuel, air and entrained combustion supporting particles. Chamber 20 is generally defined by a housing 28 having a removable lid 30. In the illustrated embodiment, housing 28 has a generally cylindrical shape with a lower section which, on the exterior side, has a truncated conical shape, and which is conically shaped on the interior. A supply of combustion supporting particles 32 is disposed within the lower portion 22 of chamber 20. A first conduit 34 supplies liquid fuel to the chamber 20. A second conduit 36 supplies atmospheric air to the chamber 20. The outlets for conduits 34 and 36 are disposed near the bottom of chamber 20 so that both liquid fuel and air are introduced into chamber 20 below a lower limit of the liquid level of the chamber. More specifically, the air conduit 36 introduces air into the chamber near the bottom of the chamber below a predetermined lower limit for the liquid fuel level. Likewise, the liquid fuel conduit introduces liquid fuel into the chamber near the bottom of the chamber below the predetermined lower limit for the liquid fuel level. A liquid level detector/controller 38 is positioned near the lower portion 22 of chamber 20 to detect the level of liquid fuel in the chamber and to operate a valve which diverts a small portion of the liquid fuel being supplied to an engine to chamber 20 when the liquid level in chamber 20 drops below a predetermined lower limit. Detector/controller also operates to close the valve when the liquid level in the chamber rises above a predetermined upper limit to prevent additional liquid fuel from entering the chamber. In the illustrated embodiment, the liquid level detector/controller 38 is a relatively simple commercially available float device which includes a vertical guide rod 40, a generally cylindrical shaped float 42 having a vertical through-bore through which guide rod 40 extends, and internal magnetically sensitive switching means which respond to magnetic material located near the upper and lower sides of float 42. Generally, any of various suitable liquid level detector/controller devices may be employed for detecting and controlling the liquid fuel level in chamber 20. Such devices are well known and will not be described in detail herein. Apparatus 10 also includes an outlet 44 from chamber 20 for conveying a mixture of vaporized fuel, air and combustion supporting particles to a vacuum inlet of an internal combustion engine.

A suitable chamber volume is from about 0.5 liters to about 5 liters, and more preferably from about 1 liter to about 2 liters. Housing 28 can be made of any suitable material, such as steel, copper, aluminum or plastic. Likewise, removable lid 30 can be made of any suitable material such as steel, copper, aluminum, brass or plastic. As shown in the illustrated embodiment, lid 30 is provided with a threaded port 85 which is closed by a threaded plug 87. Port 85 allows the supply of combustion supporting particles to be replenished as needed. Housing 28 is preferably provided with a flange 46 having a plurality of threaded apertures, and a plurality of corresponding apertures are provided near the periphery of lid 30 to allow securement of lid 30 to flange 46 with threaded fasteners 48. Liquid fuel conduit 34, air conduit 36 and outlet 44 can be made of any suitable material, such as stainless steel or copper tubing. Unlike conduits 34 and 36, the inlet opening of outlet port 44 is located near lid 30, i.e. is disposed about as far as possible from the liquid fuel to minimize the possibility of introducing entrained liquid droplets into the outlet 44. By contrast, the outlets of conduits 34 and 36 are located below the predetermined lower limit for the liquid fuel level so that air and fuel are introduced to chamber 20 within the volume occupied by the liquid fuel.

Air conduit 36 is preferably provided with a metering aperture having a diameter of from about 0.4 to abut 0.8 millimeters. It may also be desirable to provide an inlet filter on the air conduit 36 to prevent unwanted particulate matter from entering chamber 20.

The illustrated embodiment includes a shroud 50 which generally surrounds float 42 to prevent the float from being influenced by rapid fluctuations in the pressure of a vacuum inlet of an internal combustion engine which is in communication with chamber 20 through outlet 44. Such rapid fluctuations could cause erroneous liquid level readings by the detector/controller, which could cause under- or overfilling of the chamber with liquid fuel. Shroud 50 includes a plurality of apertures 52 which are disposed above the predetermined upper limit for the liquid fuel level to allow equalization of pressure on both sides of the shroud, and a plurality of rectangular openings or slots 54 disposed below the predetermined lower limit of the liquid fuel level to allow equalization of the liquid level on both sides of the shroud.

The preferred particulate material for use in the fuel system of the present invention is powdered aluminum which is available from the Aldridge Chemical Company in Wisconsin. The aluminum powder is preferably of a size which is sufficiently small to avoid any deleterious effect on the operation of an internal combustion engine. Suitable particles sizes range from about 9 microns to about 20 microns. Although larger or smaller particle sizes may be employed, it is believed that appreciable benefits are not realized by utilizing particles smaller than about 9 microns and that particles significantly larger than 20 microns may have an undesirable effect on engine performance. Other metals have been tried in the fuel system with varying degrees of success. For example, powdered palladium metal has been found to produce slightly better results than powdered aluminum. However, powdered aluminum is substantially less expensive than powdered palladium, and is therefore preferred. The fuel system of this invention would also be expected to work with other powdered metals, such as copper, brass, bronze, and even with non-metallic materials which can heat rapidly in a combustion chamber of an internal combustion engine. The particulate material can also be a mixture of different particulate materials. The particular additive to be used in the fuel system can be determined through experimentation. As suggested above, aluminum powder having a particle size of from about 9 microns to about 20 microns have been found to produce very good results and are preferred in view of their ready availability, lower expense and ease of handling. Experimental data indicate that approximately 6 ounces of aluminum powder will provide approximately 20,000 miles of improved engine performance.

A fuel system for an internal combustion engine utilizing the above described apparatus for introducing combustion supporting particles to an internal combustion engine is shown schematically in FIG. 2. Fuel system 60 includes a fuel tank 62 which can be of conventional design, a fuel pump 64, which may also be of conventional design, apparatus 10, and internal combustion engine 66. A portion of the fuel being supplied to engine 66 by pump 64 through fuel line 68 can, as needed, be diverted to apparatus 10 through fuel line 70 when valve 72 is open. Liquid fuel conduit 34 of apparatus 10 is in fluid communication with fuel line 70. The mixture of vaporized fuel, air and combustion supporting particles generated in apparatus 10 leaves chamber 20 through outlet 44 and is conveyed to internal combustion engine 66 through conduit 74. Conduit 74 is preferably provided with a check valve 75 having approximately a 5 pound pressure which protects the fuel system from the high vacuum that exists at idle or under throttled down conditions. The mixture of vaporized fuel, air and entrained combustion supporting particles generated by apparatus 10 are introduced into internal combustion engine 66 at an appropriate point, such as down stream of the fuel injectors of a fuel injected engine or to the PCV input below the fuel jets and butterfly valve of a carburetor of a carbureted internal combustion engine. Apparatus 10 can be utilized with generally any type of internal combustion engine and is generally compatible with any type of fuel system.

In operation, the liquid level in chamber 20 is monitored and controlled by liquid level detector/controller 38. Specifically, the liquid level is maintained such that the combustion supporting particles 32 at the bottom of chamber 20, and the outlets of conduits 34 and 36 are always submerged in liquid fuel. More specifically, detector/controller 38 operates control valve 72 to allow liquid fuel to enter chamber 20 through conduit 34 when the liquid level in chamber 20 reaches a predetermined lower limit, and closes valve 72 when the liquid fuel reaches a predetermined upper limit. As previously stated, the major criterion for selecting the predetermined lower limit for the liquid fuel level is maintenance of a liquid level which ensures that air and fuel are introduced into the volume of chamber 20 occupied by the liquid fuel. The predetermined upper limit for the liquid fuel level is not critical. However, various factors, such as the frequency at which valve 72 is opened and closed, the total volume of the chamber 20, and the relative proportion of liquid volume and vapor volume, should be taken into consideration. With the illustrated embodiment, a suitable lower limit for the liquid level can be about 2 inches, and a suitable upper limit for the liquid level can be about 3 inches. The outlets of air conduit 36 and liquid fuel conduit 34 are preferably located at least about 0.5 inches below the predetermined lower limit for the liquid fuel level.

It has been found that by bubbling atmospheric air through the liquid fuel and combustion supporting particles 32 in a chamber having a relatively small proportion of its volume containing liquid fuel and combustion supporting particles, and a major portion of its volume containing vaporized fuel, it is possible to generate a suitable mixture of vaporized fuel, air and combustion supporting particles which can be introduced into an internal combustion engine to improve the combustion efficiency thereof. As with my previous invention disclosed in U.S. Pat. No. 5,002,033, the mixture of vaporized fuel, air and combustion supporting particles generated by apparatus 10 comprises only a small portion of the total amount of fuel and air which is introduced into the combustion chambers of an internal combustion engine. The relatively small volume of fuel which is diverted from fuel line 68 to apparatus 10 does not require any modification of the fuel pump 64 or any significant modification of engine 66. Additionally, the apparatus 10 is relatively small, e.g. generally occupying from about 1 to 2 liters of volume, such that it is generally possible to easily add apparatus 10 to an existing fuel system for an internal combustion engine. For example, the apparatus can be easily retrofitted into existing motor vehicles, such as automobiles, trucks, boats, etc. As with my previous invention (U.S. Pat. No. 5,002,033) the mixture of fuel, air and combustion supporting particles can be passed through conduit 74 to heat exchanger 76 to maintain the fuel in a vaporized state. Heat exchanger 76 can be heated with fluid from the engine block, or with exhaust gases. It is anticipated that the apparatus 10 can improve fuel economy by as much as 50% or more.

Though the invention has been described with respect to a specific preferred embodiment thereof, many variations and modifications will become apparent to those skilled in the art. It is therefore the intention that the appendant claims be interpreted as broadly as possible in view of the prior art to include all such variations and modifications.

The embodiments of the invention in which an exclusive property or privilege is claimed are defined as follows:

1. An apparatus for introducing combustion supporting particles to an internal combustion engine, comprising:

a chamber for containing a volume of liquid fuel and a volume of vaporized fuel;

a supply of combustion supporting particles disposed within the chamber;

a conduit for supplying liquid fuel to the chamber;

a conduit for supplying atmospheric air to the chamber;

a liquid level controller for maintaining the volume of liquid fuel in the chamber within predetermined limits;

an outlet from the chamber for conveying a mixture of vaporized fuel, air and combustion supporting particles to a vacuum inlet of an internal combustion engine; and a shroud surrounding the liquid level controller to prevent erroneous liquid level readings which may be caused by rapid fluctuations in the pressure of a vacuum inlet of an internal combustion engine.

2. The apparatus of claim 1, wherein the conduit for supplying liquid fuel to the chamber introduces liquid fuel into the chamber below a predetermined lower limit for the liquid fuel level.

3. The apparatus of claim 1, wherein the conduit for supplying atmospheric air to the chamber introduces air into the chamber below a predetermined lower limit for the liquid fuel level.

4. The combination of an internal combustion engine and a fuel system therefor, comprising:

an internal combustion engine;

a fuel tank;

a fuel pump and associated conduit for conveying liquid fuel from the fuel tank to the internal combustion engine;

an apparatus for introducing combustion supporting particles to an internal combustion engine, the apparatus including a chamber for containing a volume of liquid fuel and a volume of vaporized fuel, a supply of combustion supporting particles disposed within the chamber, a conduit for supplying liquid fuel to the chamber, a conduit for supplying atmospheric air to the chamber, a liquid level controller for maintaining the volume of liquid fuel in the chamber within predetermined limits, and an outlet from the chamber for conveying a mixture of vaporized fuel, air and combustion supporting particles to a vacuum inlet of the internal combustion engine; and a valve and associated conduit for diverting liquid fuel from the fuel tank to the apparatus, the valve being operated by the liquid level controller, and conduit for conveying a mixture of vaporized fuel, air and entrained combustion supporting particles to the internal combustion engine; and a shroud surrounding the liquid level controller to prevent erroneous liquid level readings which may be caused by rapid fluctuations in the pressure of a vacuum inlet of an internal combustion engine.

5. The combination of claim 4, wherein the conduit for supplying liquid fuel to the chamber introduces liquid fuel into the chamber below a predetermined lower limit for the liquid fuel level.

6. The combination of claim 4, wherein the conduit for supplying atmospheric air to the chamber introduces air into the chamber below a predetermined lower limit for the liquid fuel level.

7. An apparatus for introducing combustion supporting particles to an internal combustion engine, comprising:

a chamber for containing a volume of liquid fuel and a volume of vaporized fuel;

a supply of combustion supporting particles disposed within the chamber;

a conduit for supplying liquid fuel to the chamber;

a conduit for supplying atmospheric air to the chamber;

an outlet from the chamber for conveying a mixture of vaporized fuel, air and combustion supporting particles to a vacuum inlet of an internal combustion engine; and a liquid level controller for maintaining the volume of liquid fuel in the chamber within predetermined limits, the liquid level controller being disposed within the chamber.

* * * * *